US005305060A

United States Patent [19]

Fukushima

[11] Patent Number: 5,305,060

[45] Date of Patent: Apr. 19, 1994

[54] IMAGE FORMING APPARATUS HAVING CONTROL MEANS FOR CONTROLLING IMAGE FORMING CONDITION

[75] Inventor: Satoru Fukushima, Kawasaki, Japan

[73] Assignee: Canon Kabushiki Kaisha, Tokyo, Japan

[21] Appl. No.: 52,531

[22] Filed: Apr. 29, 1993

[30] Foreign Application Priority Data

Apr. 30, 1992 [JP] Japan ..... 4-139767

[51] Int. Cl.[5] ..... G03G 15/00; G03G 15/02

[52] U.S. Cl. ..... 355/208; 355/219; 355/326 R

[58] Field of Search ..... 355/208, 214, 216, 219, 355/225, 326; 430/902; 346/157, 160

[56] References Cited

U.S. PATENT DOCUMENTS 4,502,777 3/1985 Okamoto et al. ..... 355/208

5,034,772 7/1991 Suzuki ..... 355/208

FOREIGN PATENT DOCUMENTS 62-283356 12/1987 Japan .

*Primary Examiner*—Joan H. Pendegrass

*Attorney, Agent, or Firm*—Fitzpatrick, Cella, Harper & Scinto

[57] ABSTRACT

An image forming apparatus includes an electrophotographic photosensitive member exhibiting non-linear relation between charge amount thereof and a potential of an electrostatic latent image formed thereon; a developing device for developing the electrostatic latent image; a latent image forming condition setting device for automatically setting the latent image forming condition in accordance with an ambient condition; the setting device including an input device for inputting information relating to a target latent image potential preset in accordance with the ambient condition; wherein when the latent image forming condition is determined on the basis of the non-linear property which is stored, a latent image is actually formed on the photosensitive member with charging conditions which are away in opposite detections from a charging condition calculated from the ambient condition, and a relation between the charge amount of the photosensitive member and the potential of the electrostatic latent image is determined by line approximation on the basis of measurement in the actual latent image formation, and then the charge amount is determined from the linear approximation.

10 Claims, 8 Drawing Sheets

IMAGE FORMING APPARATUS HAVING CONTROL MEANS FOR CONTROLLING IMAGE FORMING CONDITION

FIELD OF THE INVENTION AND RELATED ART

The present invention relates to an image forming apparatus such as a copying machine, laser beam printer or the like, and more particularly to an image density controller for controlling image density of a toner image.

Various electrophotographic image forming machines have been proposed in Japanese Laid-Open Patent Application No. 283356/1987, for example.

Such an image forming apparatus (copying machine) is provided with a photosensitive drum (image bearing member) having a photosensitive layer. The surface of the photosensitive drum is uniformly charged by a primary charger (process means) and thereafter, the surface is exposed by an exposure device (process means), so that an electrostatic latent image is formed. The electrostatic latent image is developed with toner by a developing device (process means) into a toner image. The density of the toner image thus produced is influenced by ambient humidity and temperature. This is because a contrast voltage $V_{CONT}$ determining the density of the toner image changes in accordance with the ambient humidity or temperature (absolute humidity), as shown in FIG. 3.

The contrast voltage $V_{CONT}$ is determined by a difference between the surface potential of the photosensitive drum in an exposed area and a developing bias voltage $V_{DC}$. FIGS. 7A and 7B show a relation between the contrast voltage $V_{CONT}$ and the toner image density (in the case of an image scanning type). In FIG. 7A, the ordinate represents a potential, and the abscissa represents a position in a main scan direction for the photosensitive drum. It shows a relation between a developing bias voltage $V_{DC}$ applied to a developing device and a surface potential distribution on the photosensitive drum when the surface of the photosensitive drum is uniformly charged by the primary charger to a potential (dark potential $V_D$) whereafter the surface is partly exposed to light to reduce the potential to a light potential $V_L$. Here, the potential difference between the dark potential $V_D$ and the developing bias voltage $V_{DC}$ is indicated by $V_{BACK}$. The level of $V_{BACK}$ is not less than a predetermined level for the purpose of suppressing foggy background in the non-exposed area. In FIG. 7B, the ordinate represents an image density, and the abscissa represents a position on the photosensitive drum in the main scan direction. It shows an image density distribution when the toner is deposited to the exposed portion under the condition shown in FIG. 7A.

The image density control for the purpose of avoiding the toner image density, will be described.

In order to accomplish the image density control, a surface potential sensor (surface state detecting means) for measuring a potential of the surface of the photosensitive drum is disposed faced to the photosensitive drum, and the surface potential sensor is connected to a control means.

A dark portion which is charged by the primary charger but not exposed to the light, and a light portion which is charged and exposed, are simultaneously or sequentially provided. Then, the surface potentials of these portions (dark potential and light potential) are detected by the surface potential sensor, and the data are supplied to the control means. The control means controls the amount of corona discharge or the voltage supplied to the original illumination lamp on the basis of the data. As for the method of controlling the corona discharge amount, there are a method in which controlling the corona wire voltage applied to the corona wire of the primary charger, and a method in which a grid bias voltage or the like applied to a grid electrode is controlled. In another image density control, light potential and the dark potential are measured with different grid bias voltages, and on the basis of the measurement, a potential change property is predetermined as shown in FIG. 8. On the basis of the measurement of the surface potential sensor, the contrast voltage $V_{CONT}$ is calculated, and the grid bias voltage corresponding to the contrast voltage $V_{CONT}$ is determined by the potential change property. In FIG. 8, the abscissa represents a grid bias voltage applied to the primary charger, and the ordinate represents the surface potential of the photosensitive drum. In the Figure, $V_D$ ($V_G$) shows the dark potential change property when the grid bias voltage is changed, and $V_L$ ($V_G$) shows a light potential change property when the grid bias voltage is changed.

The above-described potential change property is not always rectilinear, as shown in FIG. 8 because of the size reduction of the primary charger, the speed increase of the photosensitive drum rotational speed and the material of the photosensitive member (amorphous silicon photosensitive layer) or the like. In actual practice, it may be a curved line, as shown in FIG. 9. Therefore, even if the control is carried out on the basis of the grid bias voltage determined by the linear approximation, the desired potential contrast is not easily obtained. As a result, a substantial time period is required until the proper grid bias voltage and therefore the proper image density are reached.

Particularly in a full-color image forming apparatus in which color reproducibility and tone reproducibility are important, the change in the color reproduction due to the change of the contrast voltage $V_{CONT}$ is critical, and therefore, very accurate control is required for the contrast voltage $V_{CONT}$. If an attempt is made to accomplish this in the conventional control system, the copying operation can not be initiated until the density control is properly completed, and therefore, the inconvenience is significant.

Additionally, the potential change property per se changes depending on the deterioration of the sensitivity of the photosensitive drum or the individual machines, and therefore, the image density control is difficult.

SUMMARY OF THE INVENTION

Accordingly, it is a principal object of the present invention to provide an image forming apparatus in which a control accuracy is improved in a latent image forming condition control.

According to an aspect of the present invention, there is provided an image forming apparatus comprising: an electrophotographic photosensitive member exhibiting non-linear relation between charge amount thereof and a potential of an electrostatic latent image formed thereon; developing means for developing the electrostatic latent image; latent image forming condition setting means for automatically setting the latent image forming condition in accordance with an ambient condition; the setting means including input means for inputting information relating to a target latent image potential preset in accordance with the ambient condition; wherein when the latent image forming condition is determined on the basis of the non-linear property which is stored, a latent image is actually formed on the photosensitive member with charging conditions which are away in opposite detections from a charging condition calculated from the ambient condition, and a relation between the charge amount of the photosensitive member and the potential of the electrostatic latent image is determined by line approximation on the basis of measurement in the actual latent image formation, and then the charge amount is determined form the linear approximation.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, embodiments of the present invention will be described.

Figure 1:
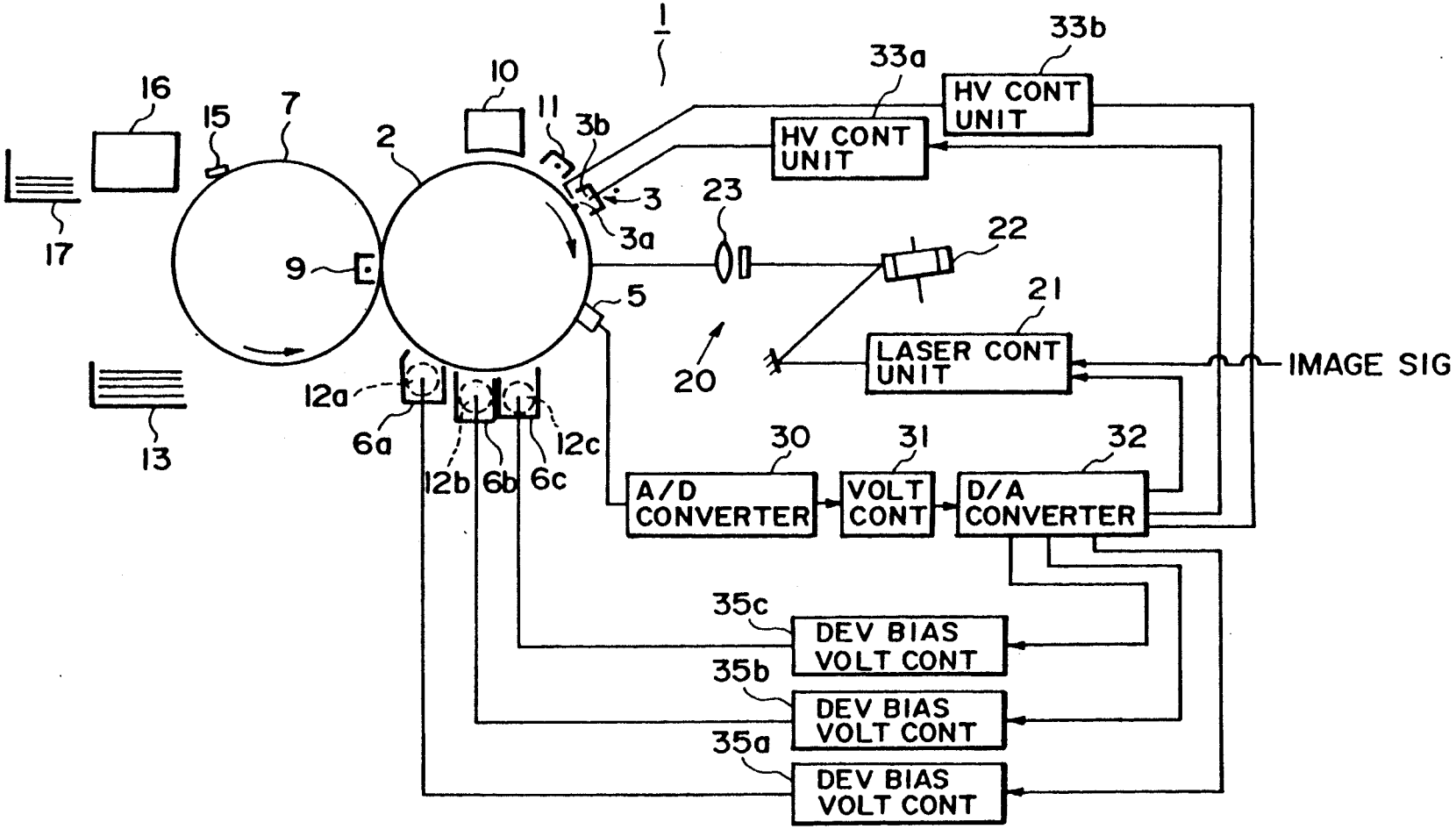
FIG. 1 shows a general arrangement of an image forming apparatus according to a first embodiment of the present invention.

FIG. 1 is a schematic view of an image forming apparatus (copying machine) according to an embodiment of the present invention. The copying machine 1 comprises a photosensitive drum (photosensitive member) 2 supported for rotation in a direction indicated by an arrow by an unshown driving means. Around the photosensitive drum 2, there are provided, in the order, a primary charger (process means) 3 for uniformly charging the surface of the photosensitive drum 2, a surface potential sensor (surface state detecting means) 5 for measuring the surface potential of the photosensitive drum 2, developing means (process means) 6*a*, 6*b* and 6*c*, containing magenta, cyan and yellow toners, for developing the electrostatic latent image formed on the surface of the photosensitive drum 2 into a toner image, a transfer drum 7 for supporting a transfer material P supplied from a sheet cassette 13, a transfer charger 9 for transferring the toner image from the surface of the photosensitive drum 2 onto the transfer material P, a cleaning device 10 for removing the residual toner from the surface of the photosensitive drum 2, and a discharging device 11 for discharging the surface of the photosensitive drum 2.

The primary charger 3 has a grid electrode 3*a* and a corona wire 3*b*, which are connected with a high voltage control units 33*a* and 33*b*, so that they are supplied with a grid bias voltage (image forming condition) $V_G$ and a corona wire application voltage (image forming condition). The above-described developing devices 6*a*, 6*b* and 6*c* are provided with developing sleeves 12*a*, 12*b* and 12*c* for carrying the toner, respectively. Each of the developing sleeves 12*a*, 12*b* and 12*c* is supplied with a developing bias voltage (image forming condition) $V_{DC}$ through a developing bias voltage control circuit 35*a*, 35*b* and 35*c*. On the other hand, the surface of the transfer drum 7 is abutted by separation pawls 15 to separate the transfer material P having received the image from the transfer drum 7. The transfer material P separated from the transfer drum 7 is subjected to an image fixing operation in an image fixing device 16, and thereafter, it is discharged onto a discharge tray 17. Adjacent the photosensitive drum 2, an exposure station (exposure means) 20 is disposed, and is provided with a laser control unit 21 for generating a laser beam modulated in accordance with image signal inputted thereto. Adjacent the laser control unit 21, a polygonal mirror 22 rotated by an unshown driving means is rotatably supported. The polygonal mirror 22 deflects the laser beam from the laser control unit 21 to scan the surface of the photosensitive drum 2. In an optical path of the laser beam, there is disposed an imaging leans 23 having an f-$\theta$ characteristic.

On the other hand, the surface potential sensor 5 is connected with an A/D converter 30, which functions to convert an analog signal from the surface potential sensor 5 into a digital signal, which in turn is transmitted to a voltage controller (control means) 31. The voltage controller 31 comprises a RAM functioning as data storing means and control data storing means, and CPU functioning as bias calculating means and control means, and the like. It is effective to perform the developing bias calculation which will be described hereinafter, or the like. The D/A converter 32 functions to re-convert the digital signal from the voltage controller 31 into an analog signal. The analog signal is transmitted to high voltage control units 33*a* and 33*b* and developing bias voltage control circuits 35*a*, 35*b* and 35*c*. The voltage controller 31 controls a voltage applied to the corona wire, grid bias voltage $V_G$ and a developing bias voltage $V_{DC}$.

Figure 2:
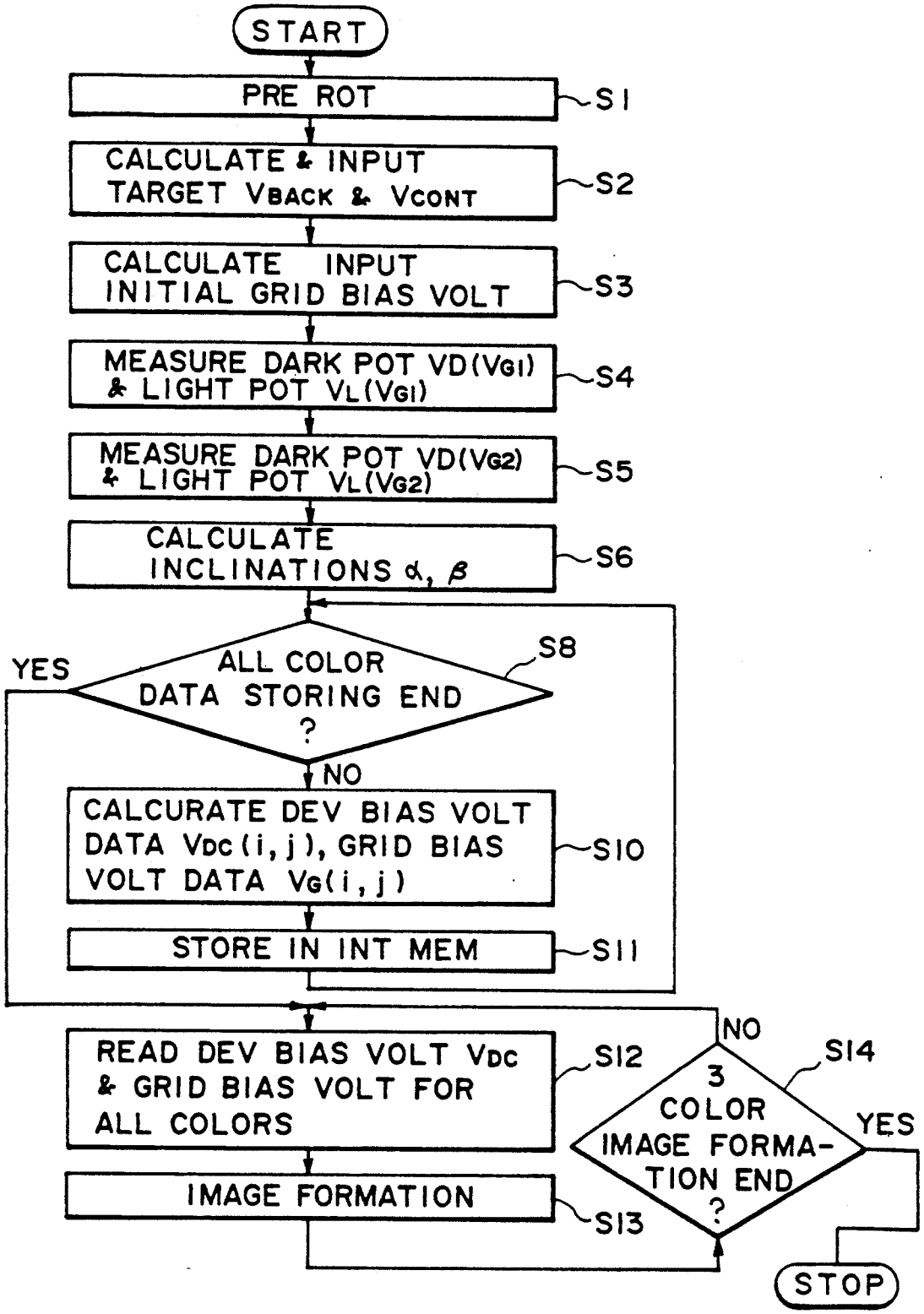
FIG. 2 is a flow charge illustrating operation of image density control.

Referring to FIG. 2, the image density control operation by the voltage controller 31 will be described.

When a start signal for the image density control is generated, the pre-rotation of the photosensitive drum 2 (S1) is started. Simultaneously therewith, the discharging device 11 electrically charges the photosensitive drum 2 to remove the residual potential therefrom. The voltage controller 31 calculates target potential differences $V_{BACK}$ and $V_{CONT}$ for each of three colors on the basis of the data shown in FIG. 6 in accordance with various image forming condition parameter such as ambient condition or the like, and the resultant data are inputted (S2).

Upon the input of the target potential difference $V_{BACK}$ and contrast voltage $V_{CONT}$ (S2), the voltage controller 31 calculates the grid bias voltage $V_G$ on the basis of the data. The process thereof will be described in detail.

Figure 3:
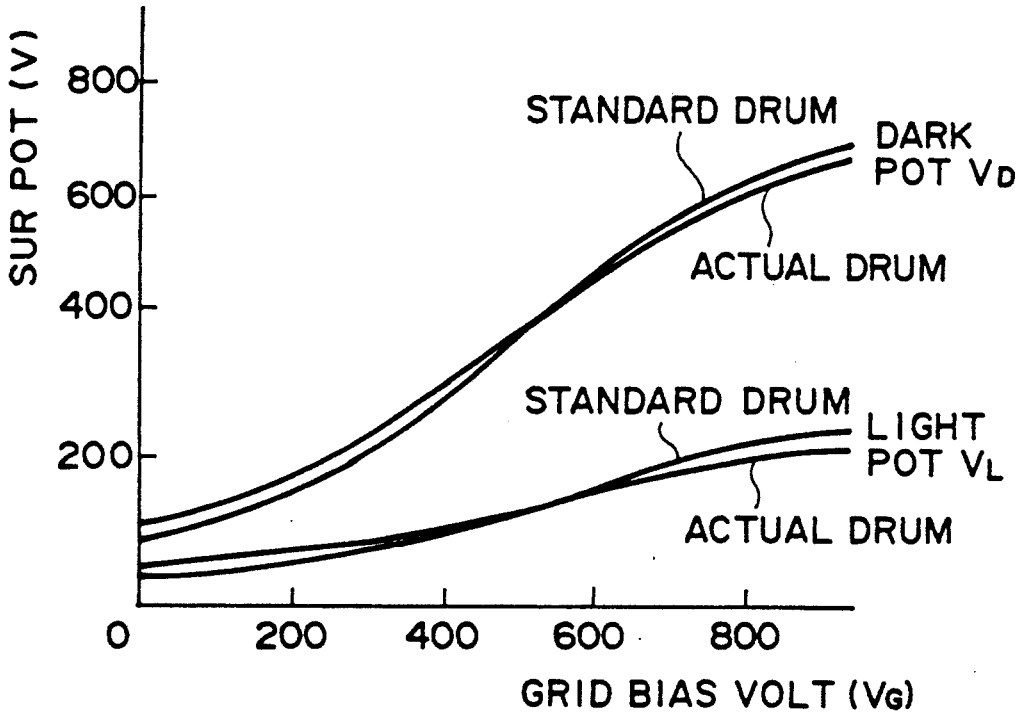
FIG. 3 shows a relation between a surface potential of a photosensitive drum and a grid bias voltage.

First, the voltage controller 31 calculates $V_D-V_L=V_{BACK}+V_{CONT}$) on the basis of the calculated $V_{BACK}$ and $V_{CONT}$. On the other hand, the voltage controller 31 stores the potential change characteristic (presumed change characteristic) for a standard photosensitive drum, as shown in FIG. 3. Using the potential change characteristic, a grid bias voltage corresponding to $V_D-V_L$ is determined. The potential change characteristic is for a particular photosensitive drum placed under a predetermined condition, and is not always the same as the potential change characteristics of an actual photosensitive drum. In an actual practice, the potential change characteristic varies depending on the deterioration of the photosensitive drum or the like, and is not the same as that for the standard photosensitive drum in cost cases. Accordingly, even if the grid bias voltage determined on the basis of the potential change characteristic for the standard photosensitive drum is applied to the developing devices 6a, 6b and 6c, no desired results can be obtained. In view of this, according to this embodiment, grid bias voltages $V_{G1}$ and $V_{G2}$ having ±20 V difference are calculated on the basis of the above calculated grid bias voltage (S3), and the surface potentials of the photosensitive drum 2 are actually measured using the grid bias voltages $V_{G1}$ and $V_{G2}$ (S4, S5).

More particularly, the surface of the photosensitive drum 2 is charged by the primary charger 3 with the grid bias voltage $V_{G1}$ applied to the grid electrode 3a, and the dark potential $V_d(V_{G1})$ without the exposure of the exposure means 20, and light potential $V_L$ ($V_{G1}$) with exposure by the exposure means 20, are measured, respectively. The results of the measurements are converged to digital signals by the A/D converter 30, and are supplied to the voltage controller 31 (S4).

As for the grid bias voltage $V_{G2}$ ($V_{G1}$) not equal $V_{G2}$), the dark potential $V_D$ ($V_{G2}$) and the light potential $V_L$ ($V_{G2}$) are measured in the similar manner, and the results are supplied as data into the voltage controller 31 (S5).

On the basis of the dark potentials $V_D$ ($V_{G1}$), $V_D$ ($V_{G2}$) and the light potential $V_L$ ($V_{G1}$), $V_L$ ($V_{G2}$), the inclinations $\alpha$ and $\beta$ are determined using the following equations (1) and (2):

$$\alpha=\{V_D(V_{G1})-V_D(V_{G2})\}/(V_{G2}-V_{G1}) \quad (1)$$

$$\beta=\{V_L(V_{G1})-V_L(V_{G2})\}/(V_{G2}-V_{G1}) \quad (2)$$

The inclinations are stored in an internal memory.

The voltage controller 31 then effects linear approximation for actual potential change characteristic of the photosensitive drum shown in FIG. 3 in a small range (−20 V−+20 V) on the basis of the inclinations $\alpha$ and $\beta$, the dark potentials $V_D(V_{G1})$, $V_D(V_{G2})$ and the light potential $V_L(V_{G1})$ and $V_L(V_{G2})$. The potential change characteristic obtained by the linear approximation is expressed by the following equations (3) and (4):

$$V_D(V_G)=\alpha(V_G-V_{G1})+V_D(V_{G1}) \quad (3)$$

$$V_L(V_G)=\beta(V_G-V_{G1})+V_L(V_{G1}) \quad (4)$$

Subsequently, the voltage controller 31 determines a grid bias voltage $V_G$ corresponding to a sum of the target potential difference $V_{BACK}$ and contrast voltage $V_{CONT}$ (S10). In addition, a developing bias voltage $V_{DC}$ is determined.

Figure 7A:
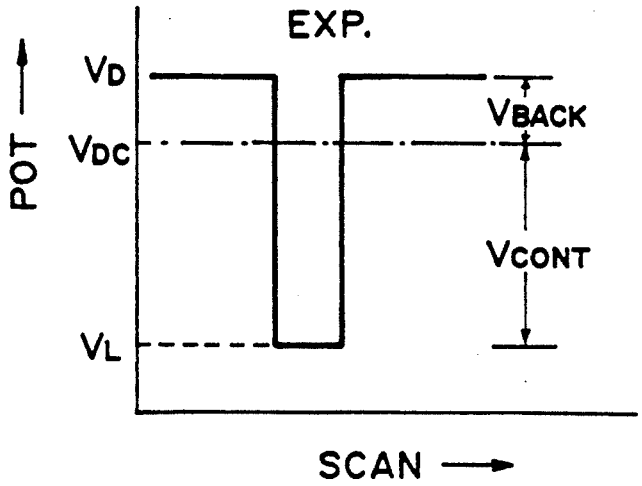
FIGS. 7A and 7B show relations between a developing bias voltage and an image density.
Figure 7B:
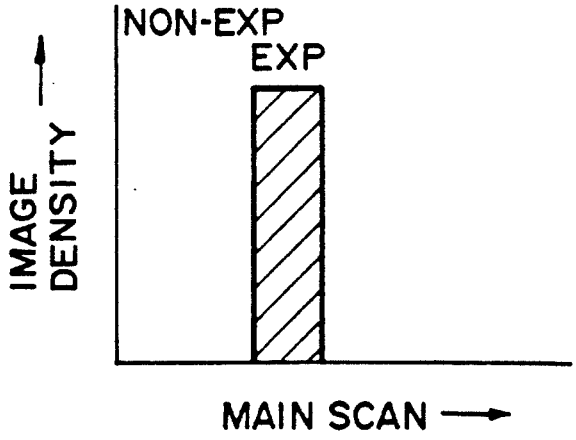
Figure 8:
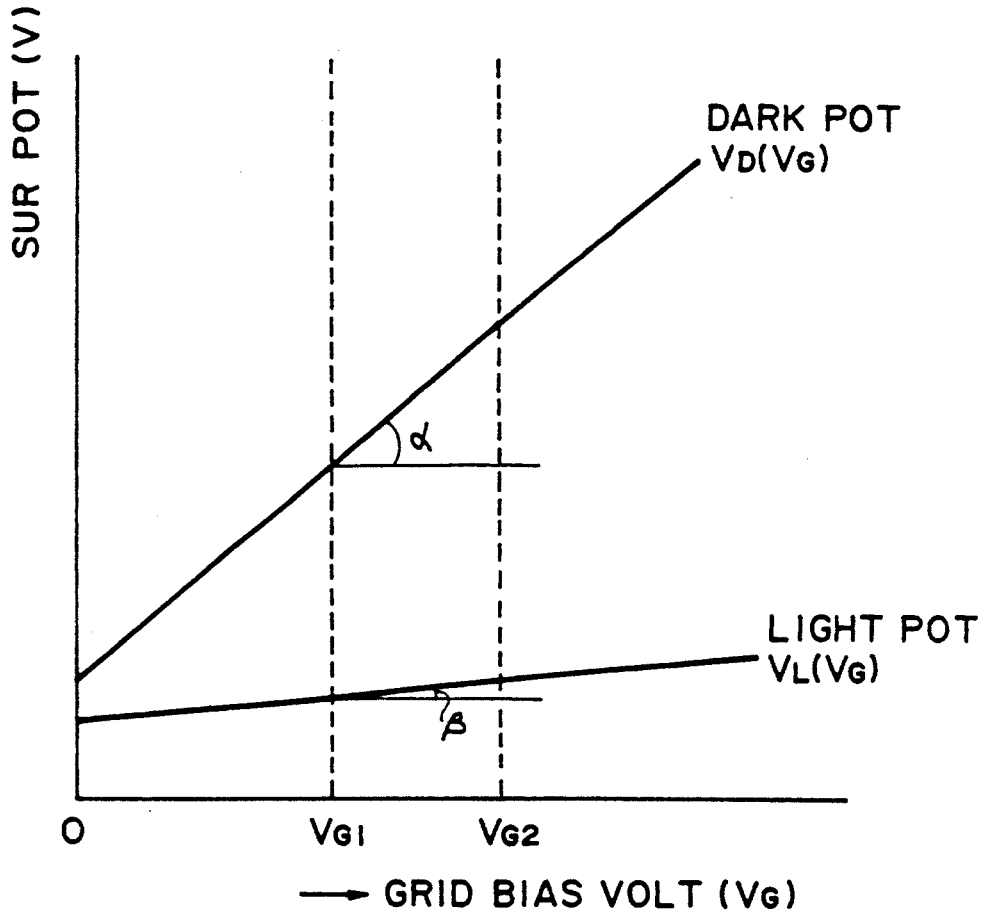
FIG. 8 shows a general potential change property for determining a grid bias voltage.

More particularly, on the basis of the relation shown in FIG. 7A, the following is provided:

$$V_D-V_L=V_{BACK}+V_{CONT} \quad (5)$$

$$V_{DC}=V_L+V_{CONT} \quad (6)$$

From equations (3) and (4), $$V_G=\{V_D(V_G)-V_L(V_G)-V_D(V_{G1})-V_L(V_{G1}))\}/(\alpha-\beta)+V_{G1}$$

From equation (5), $$V_G=\{V_{BACK}+V_{CONT}-(V_D(V_{G1})-V_L(V_{G1}(()/(\alpha-\beta)+V_{G1} \quad (7)$$

Since all of the variables in equation (7) are know, the voltage $V_G$ can be definitely determined. The grid bias voltage $V_G$ and the developing bias voltage $V_{DC}$ are calculated for each of the colors. When all of the datas for all of the colors are stored, the preparation for the image forming condition is completed (S8). Here, the light potential $V_L$, the dark potential $V_D$ and the developing bias voltage $V_{DC}$ determined on the basis of the equations (3), (4) and (6), are stored in an unshown internal memory of a voltage controller 31 in response to switching between the target potential difference $V_{BACK}$ and the potential difference $V_{CONT}$ (S11).

When the image is formed after the preparation for the image forming operation, the grid bias voltage $V_G$ and the developing bias voltage $V_{DC}$ are read out from the internal memory for each color (S12), and the data are supplied to the high voltage control units 33a and 33b and to the developing bias voltage control circuit 35a, 35b and 35c, so that the grid bias voltage $V_G$ and the developing bias voltage $V_{DC}$ are applied. With this state, the image forming operation is carried out for only one color (11), and the formed toner image is transferred onto the transfer material P. The same operation is carried out for the other colors, in which the grid bias voltage $V_G$ and the developing bias voltage $V_{DC}$ are changed for the respective colors.

Then, the discrimination is made as to whether or not the three color image forming operations are completed (S14). If not, the operation returns to step S12. If so, the image forming operation is completed.

Figure 9:
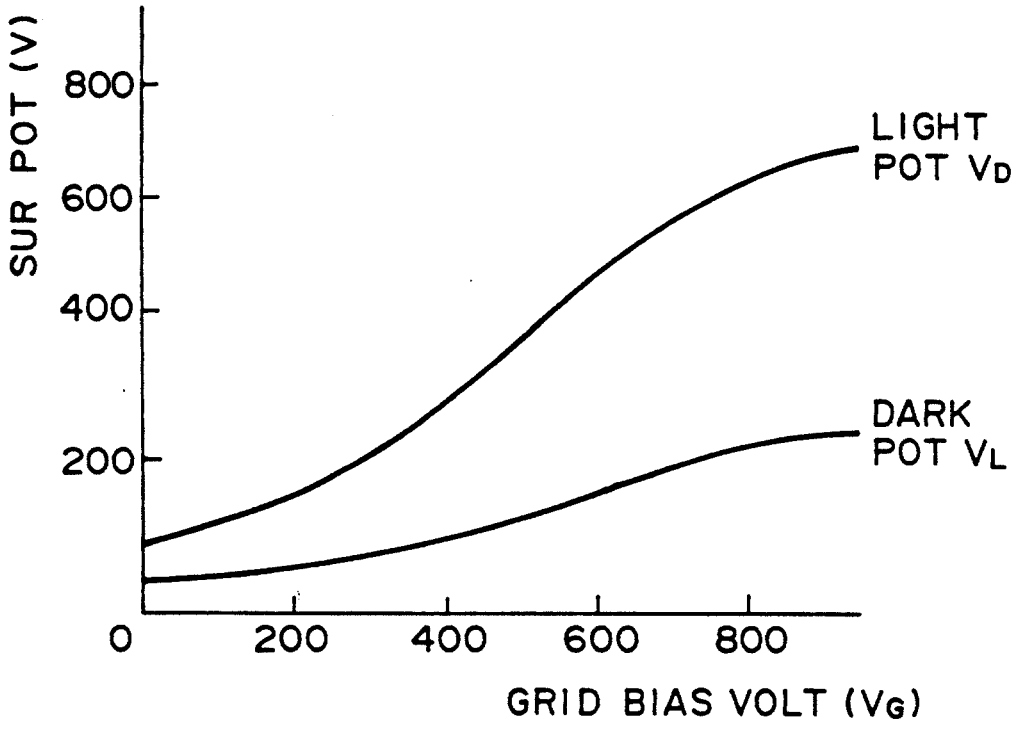
FIG. 9 shows a relation between a surface potential of the photosensitive drum and a grid bias voltage.

In the next image density control operation, the grid bias voltage is obtained using equations (3) -(7) in place of the potential change characteristic of the standard photosensitive drum. Then, the surface potentials of the photosensitive drum 2 are actually measured with the grid bias voltages $V_{G1}$ and $V_{G2}$ (S3) which is ±20 V, respectively, on the basis of the grid bias voltage thus obtained. Then, the control operation is carried out similarly. Since the potential change characteristic to be used in the image density control is obtained by line approximation in a small range (−20 V−+20 V), the obtained grid bias voltage is correct even if the actual potential change characteristic is curved as shown in FIG. 9. Therefore, the control operation can be quickly carried out.

In addition, since the potential change characteristic obtained through the image density control is used as a base for the next control, the image density control is accurate even if the potential change characteristic varies due to the deterioration of the sensitivity of the photosensitive drum or even if it varies depending on the individual machines.

The description will be made as to the selection of the small range which is the difference between the voltages $V_{G1}$ and $V_{G2}$, used in the line approximation. The characteristics of the dark potential $V_D$ and the light potential $V_L$ relative to the grid bias voltage $V_G$ changes not only in accordance with the charging property and the light decay characteristic of the photosensitive drum 2 but also in accordance with the structure and control method of the charger 3 and the exposure amount by the exposure means 20 and other characteristics. Therefore, the potential differences for the voltages $V_{G1}$ and $V_{G2}$ are not determined to a single definite value.

Generally, from the standpoint of sufficient accuracy by the line approximation for the purpose of high accuracy control, the smaller difference is desirable. However, the error is larger in the case of extrapolation than in the case of interpolation, and therefore, if the obtained $V_G$ is not between the voltages $V_{G1}$ and $V_{G2}$, the accuracy is liable to be deteriorated.

For example, when the photosensitive drum 2 is of a-Si photosensitive drum, the dielectric constant of the photosensitive drum is large, and therefore, the amount of electric charge required for providing a desired charge potential is large. Because of this, the proper control with sufficient surface potential can not be provided with scorotron charger which is normally used in the copying machine. In addition, the dark decay is significant. Accordingly, the $V_D$ and $V_L$ characteristics relative to the voltage $V_G$ is non-linear, more particularly, like cubic equation curve. In addition, the temperature dependencies of the charging property, light decay and dark decay, are significant, and therefore, the set voltage $V_G$ varies for each control.

Under the circumstances, when the a-Si drum is used as the photosensitive drum 2 for the copying machine, it is desirable to select ±20 V for the differences of the voltages $V_D$ and $V_L$, from the standpoint of providing sufficient control accuracy even if the extrapolation results due to the temperature variation or the like. Additionally, in order to provide further faithful color reproduction, the characteristic variation of the photosensitive drum 2 may be suppressed by temperature control for the photosensitive drum 2 or the like, so that the characteristic variation of the entirety of the system is suppressed, and the voltage differences are set to be ±10 V, by which the control accuracy is further improved.

The voltage difference may be properly determined by skilled in the art depending on the systems in the range of 10–100 V, for example, when a contact type charger is used for the primary charger 3, when a monochromatic copying machine is used, or the like.

Another embodiment of the present invention will be described. In this embodiment, a contrast voltage $V_{HTCONT}$ for providing an intermediate tone image density, is calculated beforehand on the basis of the ambient condition or the like. An intermediate tone potential $V_{HT}$ when the dark potential $V_D$ and the amount of the laser beam projected to the photosensitive drum are reduced to one half, is measured. The grid bias voltage $V_G$ is controlled so as to provide the set target voltage $V_{HTCONT}$. The control method is the same as in the foregoing embodiment.

Figure 4:
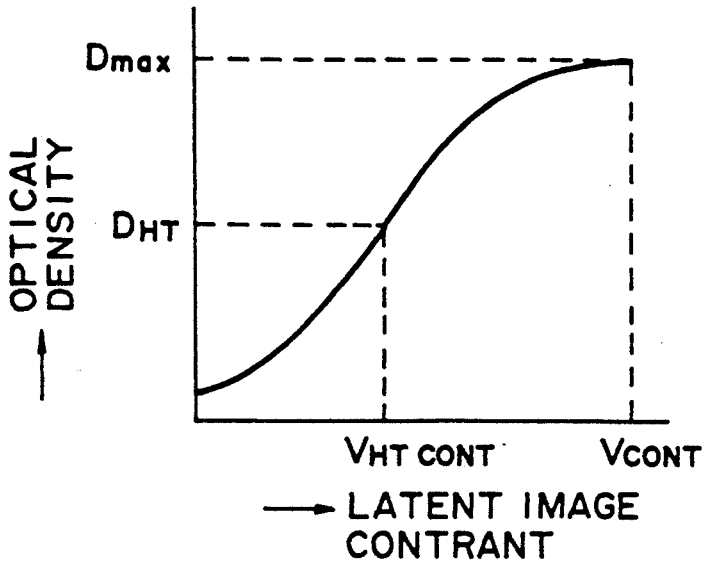
FIG. 4 illustrates a contrast voltage corresponding to a halftone image density.

Referring to FIG. 4, the voltage $V_{HTCONT}$ used in this embodiment will be described. FIG. 4 shows a relationship between the electrostatic latent image contrast and the optical density. In this Figure, $D_{MAX}$ indicates the maximum image density, $V_{CONT}$ indicates an electrostatic latent image contrast for providing the maximum image density $D_{MAX}$, and $V_{HTCONT}$ indicates the electrostatic latent image contrast providing one half image density relative to the maximum image density $D_{MAX}$.

In this embodiment, the tone reproduction and color reproduction are stabilized in the half tone region.

A further embodiment will be described. In the foregoing embodiments, the contrast voltage for providing the desired image density is selected, and on the basis thereof, the grid bias voltage $V_G$ is selected, so that the surface potential of the photosensitive drum is controlled.

In the present embodiment, in addition to that, a laser beam exposure amount for providing optimum light decay characteristic for the image formation is determined on the basis of the contrast voltage, the photosensitive drum sensitivity or the like, and the surface potential of the photosensitive drum is controlled using such image forming conditions.

By this, the tone reproducing property and the color reproducing property are stabilized even if the ambient condition or the like changes.

In this embodiment, the description has been made with respect to three color (full-color) image forming apparatus. However, the present invention is not limited to this case, but it is applicable to four color (full-color) machines, two color machines and monochromatic machines.

In the foregoing embodiment, the image forming apparatus is of an image scanning type. However, the present invention is applicable to a background scanning type or an analog image forming type.

The description has been made with respect to the case in which the bias voltages are changed to $V_{G1}$ and $V_{G2}$ at the initial stage of the control sequence operation, and the light and dark portion potentials are measured, on the basis of which, the relationship between the grid bias voltage $V_G$, the light and dark potentials $V_D$ and $V_L$. In consideration of a case in which the potential measurement of the photosensitive drum 2 is deviated due to local non-uniformity of the surface of the photosensitive drum due to pin hole or the like, a plurality of measurements for different positions of the photosensitive drum 2 may be carried out under the same charging and exposure conditions, and the minimum measurement is omitted, and the overage is obtained from the rest measurements. In this case, the surface state control data is carried out on the basis of the data excluding abnormal measurement of the surface state, and therefore, the better control is accomplished.

Figure 5:
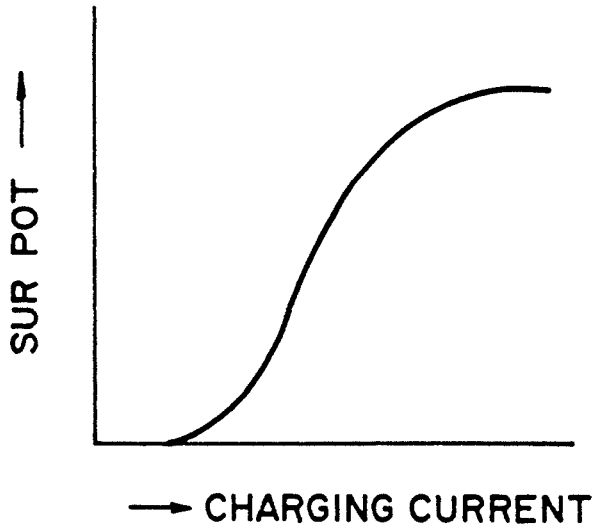
FIG. 5 shows a relation between a surface potential and a charging current.

In the foregoing, the description has been made with respect to the case in which the image forming operation is carried out with the control of the grid bias voltage $V_G$ and the developing bias potential $V_{DC}$ (potential control data). However, the same advantageous effects can be provided when, as shown in FIG. 5, the relationship between the charging current of the primary charger 3 and the surface potential of the photosensitive drum 2 is predetermined relative to the contrast voltage $V_{CONT}$ or the like, and the image forming operation is controlled on the basis thereof.

As described in the foregoing, according to the embodiments of the present invention, the control means controls the process means to provide the calculated image forming condition; the actual changing characteristic is calculated on the basis of the surface condition detected by the surface condition detecting means under the calculated image forming conditions; on the basis of the calculated changing characteristic, the image forming conditions corresponding to the target surface condition is calculated; and the process means is controlled to provide the calculated image forming conditions. Even if the changing characteristic is actually curved, the surface condition can be correctly determined. Therefore, the control operation can be quickly completed, so that the stabilized high quality image forming operation is possible.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an electrophotographic photosensitive member exhibiting non-linear relation between charge amount thereof and a potential of an electrostatic latent image formed thereon;

developing means for developing the electrostatic latent image;

latent image forming condition setting means for automatically setting the latent image forming condition in accordance with an ambient condition;

said setting means including input means for inputting information relating to a target latent image potential preset in accordance with the ambient condition;

wherein when the latent image forming condition is determined on the basis of the non-linear property which is stored, a latent image is actually formed on said photosensitive member with charging conditions which are away in opposite detections from a charging condition calculated from the ambient condition, and a relation between the charge amount of the photosensitive member and the potential of the electrostatic latent image is determined by line approximation on the basis of measurement in the actual latent image formation, and then the charge amount is determined from the linear approximation.

2. An apparatus according to claim 1, wherein said photosensitive member includes an amorphous silicon photosensitive layer.

3. An apparatus according to claim 1, wherein the charge amount provided by the line approximation is a voltage applied to a charging electrode or a current therefor.

4. An apparatus according to claim 3, wherein said setting means also sets developing bias condition.

5. An apparatus according to claim 1, wherein the ambient condition is humidity.

6. An image forming apparatus comprising:

an electrophotographic photosensitive member exhibiting non-linear relation between charge amount thereof and a potential of an electrostatic latent image formed thereon;

developing means, containing yellow, magenta and cyan developers for developing latent images corresponding to color-separated images;

latent image forming condition setting means for automatically setting the latent image forming condition in accordance with an ambient condition;

said setting means including input means for inputting information relating to a target latent image potential preset in accordance with the ambient condition;

wherein when the latent image forming condition is determined on the basis of the non-linear property which is stored, a latent image is actually formed on said photosensitive member with charging conditions which are away in opposite detections from a charging condition calculated from the ambient condition, and a relation between the charge amount of the photosensitive member and the potential of the electrostatic latent image is determined by line approximation on the basis of measurement in the actual latent image formation, and then the charge amount is determined from the linear approximation.

7. An apparatus according to claim 6, wherein said photosensitive member includes an amorphous silicon photosensitive layer.

8. An apparatus according to claim 6, wherein the charge amount provided by the line approximation is a voltage applied to a charging electrode or a current therefor.

9. An apparatus according to claim 8, wherein said setting means also sets developing bias condition.

10. An apparatus according to claim 6, wherein the ambient condition is humidity.

* * * * *

UNITED STATES PATENT AND TRADEMARK OFFICE

CERTIFICATE OF CORRECTION

PATENT NO. : 5,305,060

DATED : April 19, 1994

INVENTOR(S) : Satoru Fukushima

It is certified that error appears in the above-identified patent and that said Letters Patent is hereby corrected as shown below:

In the Drawings:

DRAWINGS

Sheet 4, Figure 4, "CONTRANT" should read --CONTRAST--.

COLUMN 1

Figure 6:
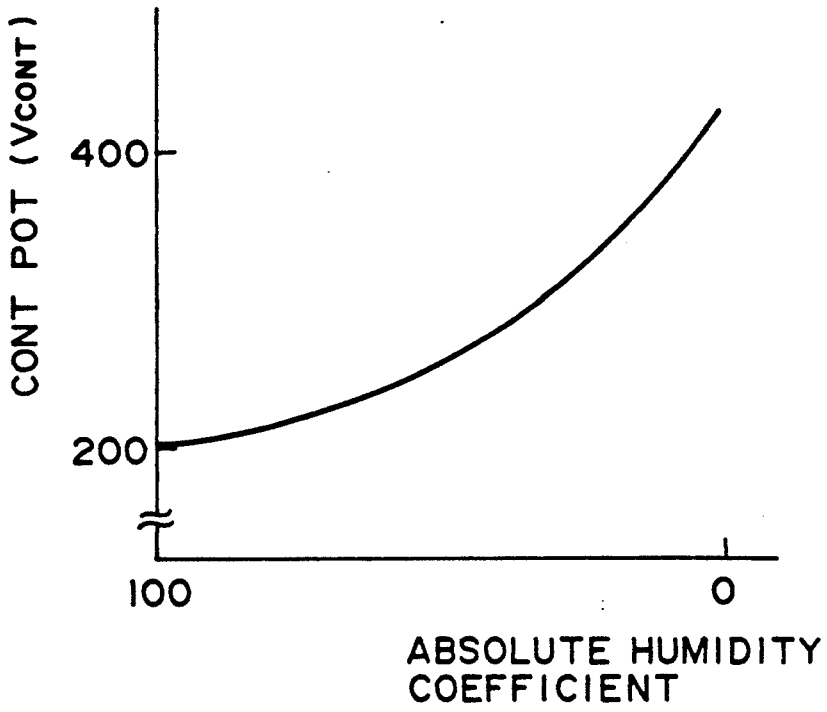
FIG. 6 shows a relation between a contrast voltage and an ambient condition (absolute humidity coefficient).

Line 30, "FIG. 3" should read --FIG. 6--.

COLUMN 3

Line 14, "form" should read --from--; and
Line 26, "charge" should read --chart--.

COLUMN 4

Line 30, "leans 23" should read --lens 23--.

COLUMN 6

Line 18, "$V_G=\{V_{BACK}+V_{CONT}-(V_D(V_{GI})-V_L(V_{GI}((\}$" should read --$V_G=\{V_{BACK}+V_{CONT}-(V_D(V_{GI})-V_L(V_{GI}))\}$--; and

COLUMN 7

Line 55, "by" should read --by one--.

Signed and Sealed this

Twenty-seventh Day of September, 1994

*Attest:*

*Attesting Officer*

Bruce Lehman

BRUCE LEHMAN

*Commissioner of Patents and Trademarks*